US007952545B2

(12) United States Patent
Benjamin et al.

(10) Patent No.: US 7,952,545 B2
(45) Date of Patent: May 31, 2011

(54) COMPENSATION FOR DISPLAY DEVICE FLICKER

(75) Inventors: Scott J Benjamin, Lakeville, MN (US); Martin J. Andrusiak, St. Paul, MN (US); Ralph A. Werner, Burnsville, MN (US)

(73) Assignee: Lockheed Martin Corporation, Bethesda, MD (US)

( * ) Notice: Subject to any disclaimer, the term of this patent is extended or adjusted under 35 U.S.C. 154(b) by 762 days.

(21) Appl. No.: 11/710,332

(22) Filed: Feb. 23, 2007

(65) Prior Publication Data

US 2007/0236432 A1 Oct. 11, 2007

Related U.S. Application Data

(60) Provisional application No. 60/789,728, filed on Apr. 6, 2006.

(51) Int. Cl.
*G09G 3/36* (2006.01)

(52) U.S. Cl. ..... 345/87; 345/89; 348/790

(58) Field of Classification Search ..... 345/87
See application file for complete search history.

(56) References Cited

U.S. PATENT DOCUMENTS

| | | | | |
|---|---|---|---|---|
| 3,643,011 | A | 2/1972 | Engel et al. | |
| 4,855,831 | A | 8/1989 | Miyamoto et al. | |
| 4,888,529 | A | 12/1989 | Madsen et al. | |
| 4,910,598 | A | 3/1990 | Itakura et al. | |
| 5,105,313 | A | 4/1992 | Stewart | |
| 5,128,782 | A | 7/1992 | Wood | |
| 5,359,712 | A | 10/1994 | Cohen et al. | |
| 5,396,157 | A | 3/1995 | Hackett et al. | |
| 5,416,599 | A | 5/1995 | Ubukata et al. | |
| 5,438,342 | A | 8/1995 | Yamaguchi | |
| 5,526,129 | A | 6/1996 | Ko | |
| 5,592,190 | A | 1/1997 | Okada et al. | |
| 5,619,224 | A | 4/1997 | Hoshino et al. | |
| 5,619,349 | A | 4/1997 | Ueda et al. | |
| 5,627,555 | A | 5/1997 | den Hollander | |
| 5,650,801 | A | 7/1997 | Higashi | |
| 5,936,621 | A | 8/1999 | Medin et al. | |
| 6,151,075 | A * | 11/2000 | Shin et al. | 348/459 |
| 6,359,663 | B1 * | 3/2002 | Gadeyne et al. | 348/790 |

(Continued)

FOREIGN PATENT DOCUMENTS

CA 2 327 429 10/1999

(Continued)

OTHER PUBLICATIONS

Kimura, N. et al, "60.2: Invited Paper: New Technologies for Large-Sized High-Quality LCD TV", 2005 SID International Symposium, May 24, 2005, pp. 1734-1737, Vol. XXXVI, SID International Symposium.*

(Continued)

*Primary Examiner* — Richard Hjerpe
*Assistant Examiner* — Dorothy Harris
(74) *Attorney, Agent, or Firm* — Mueting, Raasch & Gebhardt, P.A.

(57) ABSTRACT

Systems and methods are provided for use in correcting flicker of a display (e.g., an LCD display). For example, correction may employ the insertion of at least one transition data frame between display data frames for use in displaying a transition image by pixel elements of the display such that a user perceives display of a constant average luminance by the pixel elements.

24 Claims, 4 Drawing Sheets

U.S. PATENT DOCUMENTS

| | | | | |
|---|---|---|---|---|
| 6,909,472 | B2 * | 6/2005 | Gadeyne et al. | 348/750 |
| 2001/0024181 | A1 * | 9/2001 | Kubota et al. | 345/87 |
| 2002/0024481 | A1 * | 2/2002 | Kawabe et al. | 345/87 |
| 2002/0067464 | A1 * | 6/2002 | Werner | 352/40 |
| 2005/0062702 | A1 * | 3/2005 | Lee et al. | 345/89 |
| 2005/0184949 | A1 * | 8/2005 | Kamimura | 345/98 |
| 2005/0210338 | A1 | 9/2005 | Young | |
| 2006/0072664 | A1 * | 4/2006 | Kwon et al. | 375/240.16 |
| 2006/0208998 | A1 * | 9/2006 | Okishiro et al. | 345/102 |
| 2009/0109290 | A1 * | 4/2009 | Ye et al. | 348/155 |

FOREIGN PATENT DOCUMENTS

| | | | |
|---|---|---|---|
| EP | 0 300 754 | | 1/1989 |
| EP | 0 487 140 | A1 | 5/1992 |
| EP | 0 553 865 | A2 | 8/1993 |
| EP | 0 603 713 | A1 | 6/1994 |
| EP | 0 608 056 | A1 | 7/1994 |
| EP | 0 822 536 | A2 | 2/1998 |
| EP | 0 951 007 | A1 | 10/1999 |
| EP | 0 951 007 | B1 | 12/1999 |
| EP | 1 521 237 | A2 | 4/2005 |
| EP | 1 571 644 | | 9/2005 |
| GB | 2 191 667 | | 12/1987 |
| JP | 04-288589 | A | 10/1992 |
| WO | WO 94/09475 | | 4/1994 |
| WO | WO 94/23532 | | 10/1994 |
| WO | WO 97/12355 | | 4/1997 |
| WO | WO 97/33271 | | 9/1997 |
| WO | WO 99/54865 | | 10/1999 |

OTHER PUBLICATIONS

McCartney, 48.3: A Liquid Crystal Display Response Time Compensation Feature Integrated into an LCD Panel Timing Controller, 2003, SID 03 Digest, pp. 1350-1353.*

U.S. Appl. No. 60/789,728, filed Apr. 6, 2006, Benjamin et al.

McCartney, "48.3: A Liquid Crystal Display Response Time Compensation Feature Integrated Into an LCD Panel Timing Controller," *SID 03 Digest*, 2003:1350-1353.

McCartney et al., "The Primary Flight Instruments for the Boeing 777 Airplane," *98/SPIE*, Cockpit Displays, Honeywell, Inc., Phoenix, AZ, Apr. 7-8, 1994;2219:98-107.

McCartney et al., "Performance Testing of the Primary Flight Instruments for the Boeing 777 Airplane," *86/SPIE*, Cockpit Displays III, Honeywell, Inc., Phoenix, AZ, Apr. 10-11, 1996;2734:86-93.

Okumura et al., "32.3: A New Low-Image-Lag Drive Method for Large-Size LCTVs," *SID International Symposium Digest of Technical Papers*, Toshiba R & D Center, Kawasaki, Japan, May 1992:601-604.

International Search Report and Written Opinion from related International Application No. PCT/US2007/007435 (16 pgs.).

* cited by examiner

COMPENSATION FOR DISPLAY DEVICE FLICKER

CROSS-REFERENCE TO RELATED APPLICATIONS

This application claims the benefit of U.S. Provisional Application Ser. No. 60/789,728 filed 6 Apr. 2006, entitled "Compensation for Display Device Flicker," which is incorporated herein by reference in its entirety.

FIELD OF THE INVENTION

The present invention relates generally to the display of images on display devices (e.g., display devices that may have differing state transition rates, such as liquid crystal displays (LCDs)), and, at least in one embodiment, pertains to the display of moving images, for example, from computer data or digital video sources that are displayed on an LCD.

BACKGROUND OF THE INVENTION

The display of images on display devices such as a cathode ray tube (CRT) or a liquid crystal display (LCD) is a known art. The problem of luminance flashes or luminance jumps on LCDs is caused, at least in part, by differences between the rise and fall rates of pixel luminance changes. It is also known that the rise and fall rates of LCD pixel luminance changes are affected by a number of factors including, for example, the initial and final color state (e.g., image content), LCD type, manufacturing process variation, temperature variation and viewing angle. Further, it is also known that human eye sensitivity to the luminance jumps on LCDs varies with each individual.

The pixel luminance rise and fall rates of an LCD may differ due in part to the physics of liquid crystals. Therefore, for any particular pixel luminance transition, either the pixel rise rate may be faster than the pixel fall rate or the pixel fall rate may be faster than the pixel rise rate depending upon the manufacturer's design.

A scrolling image on a display, such as a sonar waterfall image, may exhibit substantial flicker with each scroll step of the image. A typical sonar waterfall display contains random noise displayed as gray scale data. When the image is scrolled, a large number of pixels may be changing from light to dark at the same time that a large number of pixels are changing from dark to light. Differing rise and fall rates during these complementary pixel transitions may result in discernible but unexpected and undesirable transient luminance variations or flashes, also referred to as flicker.

The LCD industry has typically been driven to minimize pixel response time which is defined as the sum of the rise and fall times. Therefore, there seems to be little motivation to match the pixel rise and fall rates, although it may be technically possible, because the matching of the pixel rise and fall rates could increase the pixel response time. The resulting flicker problem, due at least in part to the differing rise and fall rates, does not seem to affect enough users of LCDs to influence the decision to minimize pixel response time rather than match rise and fall rates.

U.S. Pat. No. 6,359,663 entitled "Conversion of a Video Signal for Driving a Liquid Crystal Display," issued Mar. 19, 2002 to Gadeyne et al., and U.S. Pat. No. 6,909,472 entitled "Conversion of a Video Signal for Driving a Liquid Crystal Display," issued Jun. 21, 2005 to Gadeyne et al. describe a method and apparatus for conversion of one input video signal to a second output video signal where the second video signal is modified from the first video signal to substantially match the luminance rise and fall times in shape and amplitude though inverted in slope for the LCD.

One drawback of the Gadeyne et al. apparatus and method is that this method is applied to all pixel elements within the LCD display. By slowing all pixel transition times to the slowest pixel transition time, the Gadeyne et al. method may cause smearing and loss of contrast when pixel changes happen faster than the slowest pixel transition. This smearing and loss of contrast will happen over the entire display instead of being isolated to a single data display window used for, for example, the display of sonar waterfall data. Therefore, motion video, such as camera video, played in a separate window on the display would receive potentially undesirable smearing and contrast loss.

Another drawback to the Gadeyne et al. apparatus and method is that a different complex implementation to substantially match the luminance rise and fall times in shape and amplitude is necessary to provide compensation for different specific display devices. As such, flicker compensated display of a sonar waterfall, for example, is limited only to those devices for which a specific complex implementation has been provided.

SUMMARY OF THE INVENTION

In one or more embodiments, an algorithm is presented that inserts transition frames in between display data frames, such that the average luminance variation across transition and display data frames is minimized (e.g., such that a substantially constant average luminance is perceived by a user), substantially reducing the luminance flash resulting from differing state transition rates (e.g., color state transition rates) between display data frames. In one or more embodiments, the algorithm processes display data frames at a rate of up to the refresh rate of the display device, and creates transition frames (e.g., where the color state transition rates are slowed) to adjust the average luminance. In one or more embodiments, the result of the algorithm is a sequence of dark and light luminance flashes that effectively cancel each other creating the perception to a user of substantial flicker reduction.

Further, in one or more embodiments, the algorithm allows for operator adjustment of flicker reduction accomplished with the inserted transition frames. Yet further, in one or more embodiments, the algorithm with operator adjustment allows the operator to compensate for initial and final color state (image content), manufacturing process variation, temperature variation, individual human eye sensitivity variations and manufacturer design variation (any LCD display).

A method for use in correcting flicker in a display according to one embodiment of the present invention is described. The display includes a plurality of pixel elements (e.g., one or more of the pixel elements having a luminance rise rate that may be different than a luminance fall rate for the pixel element). The method includes providing a first display data frame of a plurality of sequentially provided display data frames (e.g., the first display data frame for use in initiating display of a first image by the plurality of pixel elements at a first time) and providing a second display data frame subsequent to the first display data frame (e.g., the second display data frame for use in initiating display of a subsequent image by the plurality of pixel elements at a second time). The method further includes inserting at least one transition data frame between the first display data frame and the subsequent second display data frame for use in displaying a transition image by the plurality of pixel elements such that a user perceives display of a constant average luminance by the plurality of pixel elements. The display of the transition image causes a plurality of luminance variations from average luminance. The plurality of luminance variations include both positive and negative luminance variations relative to average luminance such that the plurality of luminance variations cancel each other out over time as perceived by the user.

In one embodiment of the method, only one transition data frame is generated for insertion.

Further, in another embodiment, the positive luminance variations from average luminance are about equal to the negative luminance variations from average luminance.

In another embodiment of the method, inserting at least one transition data frame between the first display data frame and the subsequent second display data frame includes generating the at least one transition data frame using the subsequent second display data frame, the first display data frame, and one or more user provided parameters.

In another embodiment of the method, inserting at least one transition data frame between the first display data frame and the subsequent second display data frame includes recording a copy of the first display data frame in a previous frame memory buffer upon being provided for use in initiating display of a first image by the plurality of pixel elements at the first time; copying the subsequent second display data frame to a new frame memory buffer; generating the at least one transition data frame using the subsequent second display data frame copied to the new frame memory buffer, the first display data frame copied to the previous frame memory buffer, and the one or more user provided parameters; providing the at least one transition data frame for use in displaying at least one transition image by the plurality of pixel elements; and recording a copy of the second display data frame in the previous frame memory buffer upon being provided for use in initiating display of the second image by the plurality of pixel elements at the second time.

In yet one or more other embodiments, the one or more user provided parameters include a selected percentage corresponding to a selected transition state of a pixel element; a user viewing the displayed image is provided with an input mechanism for receiving input to adjust one or more parameters upon which the at least one transition data frame is based; and/or the plurality of pixel elements form a window within a display that includes additional pixel elements for displaying one or more other images.

Another method for use in correcting flicker of a display according to another embodiment of the present invention includes providing a plurality of display data frames to be sequentially displayed using the plurality of pixel elements of the display and inserting at least one transition data frame between each display data frame and a subsequent display data frame of the plurality of the display data frames (e.g., the at least one transition data frame being generated using one or more user provided parameters). Further, the method includes providing an input apparatus to a user for modifying the one or more user provided parameters used to generate the at least one transition data frame so as to allow the user to adjust one or more luminance characteristics of the display of the plurality of display data frames using the plurality of pixel elements.

In one embodiment of the method, only one transition data frame is generated for insertion between each display data frame and a subsequent display data frame.

In another embodiment of the method, the at least one transition data frame inserted between the display data frame and a subsequent display data frame is generated using a copy of the display data frame and the subsequent display data frame between which the at least one transition data frame is inserted, in addition to the one or more user provided parameters.

Yet further, in one or more other embodiments of the method, the one or more user provided parameters include a selected percentage corresponding to a selected transition state of one or more pixel elements and/or the plurality of pixel elements form a window within a display that includes additional pixel elements for displaying one or more other images.

A system for use in correcting flicker of a display device that includes a plurality of pixel elements is also described (e.g., one or more of the pixel elements have a luminance rise rate that may be different than a luminance fall rate for the pixel element). The system includes application processing apparatus to generate a plurality of sequential display data frames, a new frame memory buffer to receive a copy of a new display data frame of the plurality of sequential display data frames to be displayed, and a previous frame memory buffer to receive a copy of a display data frame of the plurality of sequential display data frames which has been provided for display by the plurality of pixel elements. Further, the system includes processing apparatus to generate at least one transition data frame to be inserted between each display data frame and a subsequent display data frame of the plurality of sequential display data frames. The at least one transition data frame is generated using a new display data frame copied to the new frame memory buffer, a display data frame copied to the previous frame memory buffer, and one or more user provided parameters.

In one embodiment of the system, only one transition data frame is generated for insertion into the plurality of sequential display data frames for display prior to a subsequent display data frame and after the display data frame copied to the previous frame memory buffer.

In one or more of other embodiments of the system, the one or more user provided parameters may include a selected percentage corresponding to a selected transition state of a pixel element, the system may further include an input apparatus configured to allow a user to modify the one or more user provided parameters used to generate the one or more transition data frames, and/or the plurality of pixel elements may form a window within the display device that includes additional pixel elements for displaying one or more other images.

Yet another method for use in correcting flicker of a display according to one embodiment of the present invention is described. The method includes providing a plurality of sequentially provided display data frames and generating a plurality of transition data frames to be displayed using a plurality of pixel elements of the display. Each of the plurality of transition data frames is generated using a new display data frame of the plurality of sequentially provided display data frames, a previously generated transition data frame generated using a display data frame of the plurality of sequentially provided display data frames provided prior to the new display data frame, and one or more user provided parameters. The method may, in one embodiment, further include providing an input apparatus configured to allow a user to modify the one or more user provided parameters used to generate the plurality of transition data frames so as to allow the user to adjust luminance characteristics of the display of the plurality of transition data frames using the plurality of pixel elements.

Yet another system for use in correcting flicker of a display device that includes a plurality of pixel elements is also described. The system includes application processing apparatus to generate a plurality of sequential display data frames, a new frame memory buffer to receive a copy of a new display data frame of the plurality of sequential display data frames, and a previous frame memory buffer to receive a copy of a transition data frame of a plurality of transition data frames which has been provided for display by the plurality of pixel elements. Further, the system includes processing apparatus to generate the plurality of transition data frames to be displayed using the plurality of pixel elements. Each of the plurality of transition data frames is generated using a new display data frame of the plurality of sequential display data frames, a previously generated transition data frame generated using a display data frame of the plurality of sequential display data frames provided prior to the new display data frame, and one or more user provided parameters.

In one embodiment of the system, the system further includes an input apparatus configured to allow a user to modify the one or more user provided parameters used to generate the plurality of transition data frames.

The above summary of the present invention is not intended to describe each embodiment or every implementation of the present invention. Advantages, together with a more complete understanding of the invention, will become apparent and appreciated by referring to the following detailed description and claims taken in conjunction with the accompanying drawings.

BRIEF DESCRIPTION OF THE DRAWINGS

The present invention is described by reference to the drawings in which.

DETAILED DESCRIPTION OF THE INVENTION

The present invention shall generally be described with reference to FIGS. 1, 2A-2C, and 3A. Further, various embodiments of the present invention shall then be described with reference to FIGS. 1-4.

Figure 1:
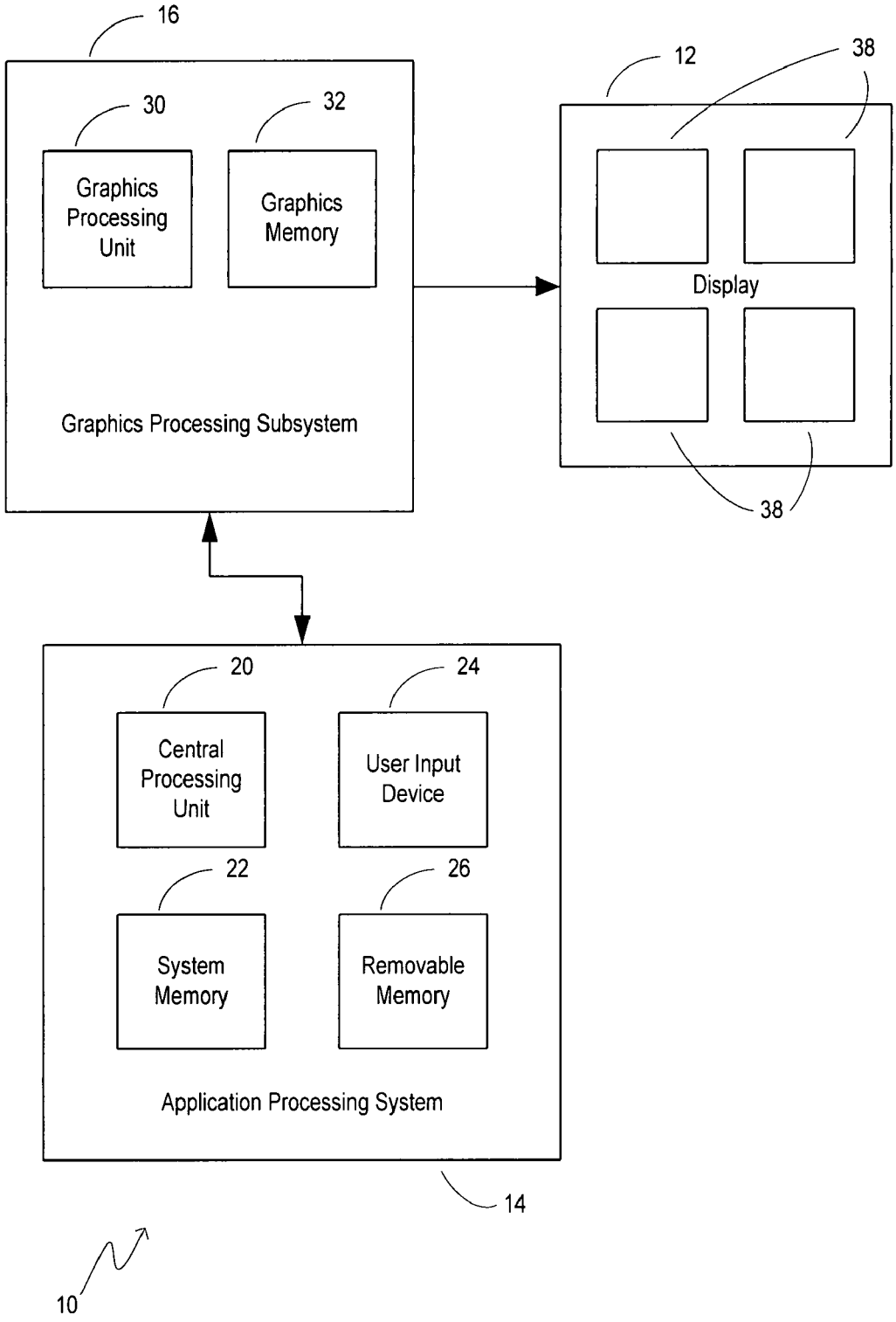
FIG. 1 shows a general block diagram of a system for correction of flicker on a display device according to one or more embodiments of the present invention.

FIG. 1 shows a general block diagram of a system 10 for correction of flicker on a display device 12 thereof according to one or more embodiments of the present invention. In one embodiment, as shown in FIG. 1, the system 10 includes application processing system 14 associated with graphics processing subsystem 16 (e.g., generally coupled together via a system bus). Generally, the application processing system 14 and graphics processing subsystem 16 are functional to provide a plurality of sequential display data frames.

As shown in the embodiment of FIG. 1, the application processing system 14 includes a central processing unit (CPU) 20 and a system memory 22 communicating therewith. User input (e.g., selection of user selected parameters to control luminance according to the present invention) is received from one or more input devices 24 (e.g., keyboard, mouse, voice activated devices, or any other input devices). User input may be stored in the system memory 22 or a removable memory 26 that may also be associated with the system 14.

Various types of input mechanisms (e.g., a graphical user interface provided to the user) may be used to allow a user to select one or more user selected parameters according to the present invention for use in adjusting the reduction of flicker. For example, user selected parameters may be input using a windowing component, pull down menus, tuning mechanisms, control actuators, touch screens, on-screen slider control, text entry box, input value stored in a configuration file, etc. As described further herein, at least in one embodiment, adjustment for optimization of flicker reduction for a user in a particular viewing environment may be accomplished with the input of user selected parameters provided by a user using any interface allowing for input or selection of such parameters. The present invention is not limited to any particular interface. These user selected parameters may also be stored in the system memory 22 or the removable memory 26.

Visual output is provided on display device 12 (e.g., an LCD) operating under control of graphics processing subsystem 16 coupled to application processing system 14. Other components, such as one or more removable storage devices 26 (e.g., compact disk drive, flash drive, DVD drive, etc.) may form a part of the application processing system 14 coupled onto the system bus. The system bus coupling the various components of the system 10 may be implemented using any one of various bus protocols including, for example, peripheral component interconnect (PCI), accelerated graphics port (AGP), etc.

Generally, graphics processing subsystem 16 includes a graphics processing unit (GPU) 30 and graphics memory 32, which may be implemented, for example, using one or more integrated circuit devices such as programmable processors, application specific integrated circuits (ASICs), and memory devices. Graphics memory 32 may include any necessary buffering capabilities required to carry out one or more embodiments of the present invention (e.g., new frame buffer, output frame buffer, etc.). The graphics processing unit 30 may be configured to perform various tasks related to generating output pixel data from graphics data (e.g., a plurality of sequential display data frames) provided by the system bus (e.g., implementing various rendering algorithms), interacting with graphics memory 32 to store and update pixel data, and the like. Scan out logic may be provided for implementing a scan out of pixel data to the display device 12 (e.g., from an output frame buffer) for display by a plurality of pixels thereof.

One skilled in the art will recognize that the system 10 described herein is illustrative and that variations and modifications are possible. For example, a GPU may be implemented using any suitable technologies, e.g., one or more integrated circuit devices, one or more processors, integrated into a system chipset, as part of a personal computer system architecture, etc. The graphics processing subsystem 16 may include any amount of graphics memory 32 and may use system memory 22 and the graphics memory 32 in any combination. For example, any memory buffers required to carry out the functionality of one or more embodiments of the present invention may be implemented in any combination of graphics memory or system memory. Further, various implementations of the system software architecture are described herein. However, the present invention is not limited to any particular architecture, but is limited only as described in the pending claims and equivalents thereof.

Any type of LCD, including flat panel LCD, front projector LCD, or rear projector LCD, which include a plurality of pixels for displaying one or more images in one or more windows may benefit from the present invention due to the typically different luminance rise and fall rates of the pixels of an LCD. For example, the display device 12 of the system 10 may include or may form a part of any type of display screen being viewed by a user (e.g., a display screen controlled by one or more processing apparatus), a computer screen, a flat screen, a heads up display, backlit display screens, see-through displays, non-see-through displays, an instrument panel, or any other type of pixel element display device that provides information to a user where controlling flicker may be beneficial.

In one or more embodiments of the system 10, the system 10 may provide for the display of multiple windows 38 of images on the display device 12. For example, the windows may be displayed at the same time with different or the same type of images, the windows may be displayed sequentially (e.g., one window provided and then switched to another), or may be displayed in any other manner as would be appreciated by one skilled in the art. In one embodiment, for example, the algorithm used to reduce flicker according to the present invention only modifies the data in a display window that displays a waterfall sonar image, while a window that displays camera video data is unaffected. In other words, transition frames according to the present invention are only provided to reduce flicker with respect to the waterfall sonar image, leaving one or more other windows displaying one or more other images unaffected by the technique used to reduce flicker (e.g., the flicker compensation technique is not applied to the entire display used to display multiple windows).

The present invention uses transition frames generated for display by one or more pixels of the display device 12 to correct for flicker that would normally be present when displaying an image thereon due to the differing pixel element rise and fall rates (e.g., luminance jumps during complementary pixel transitions). The Gadeyne et al. patents (i.e., U.S. Pat. Nos. 6,359,663 and 6,909,472) provide a description of the cause of a luminance jump resulting from differing pixel element rise and fall rates, and as such, the cause of such luminance jumps shall not be repeated in detail herein.

Figure 2A:
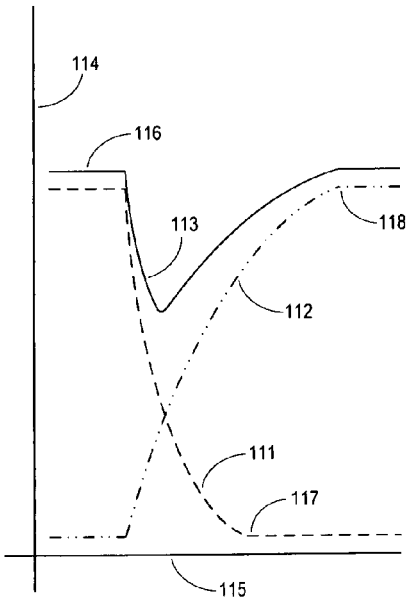
FIG. 2A shows a graph that illustrates opposing color state transitions at different rates resulting in a luminance dark flash.

FIG. 2A shows a pixel falling luminance 111 for a pixel and a pixel rising luminance 112 for another pixel during a complimentary pixel transition (e.g., transition when one pixel is going from light to dark and an adjacent pixel is transitioning from dark to light, or vice versa); with luminance on the vertical axis 114 and time on the horizontal axis 115. Further, FIG. 2A shows total luminance 113 that includes the sum of falling luminance 111 and rising luminance 112. The pixel transitions occur periodically at the video refresh time corresponding to the video refresh rate of the display, for example 60 Hz or 16.6 ms.

In the exemplary graph of FIG. 2A, the total luminance 113 shows a predominately large negative luminance variation (i.e., luminance jump) from average luminance 116 resulting in a dark flash (e.g., flicker). In other words, a dark flash or flicker results from a luminance dip caused by the luminance fall rate 111 being faster than the luminance rise rate 112. The total luminance 113 is lower than the average luminance 116 prior to the video frame update time and lasting until both pixel transitions reach their final color state 117 and 118.

Figure 2B:
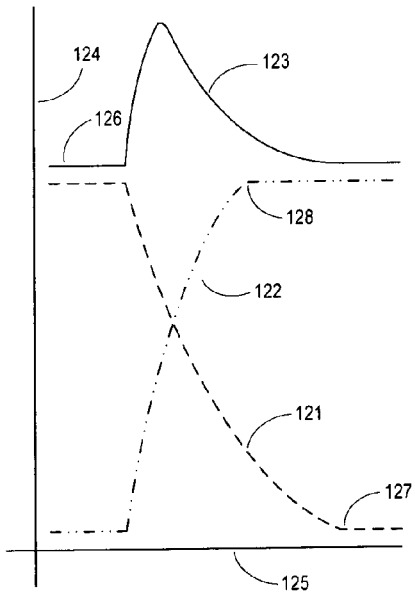
FIG. 2B shows a graph that illustrates opposing color state transitions at different rates resulting in a luminance bright flash.

FIG. 2B shows the opposite case of a luminance bright flash (e.g., flicker or luminance jump) as compared to the luminance dark flash of FIG. 2A. In FIG. 2B, the total luminance 123 (i.e., that includes the sum of falling luminance 121 and rising luminance 122) shows a predominately large positive luminance variation (i.e., luminance jump) that exceeds the average luminance 126 and lasts until the pixel rise and fall transitions reach their final color state 127 and 128. In this case, the pixel luminance rise rate 122 is faster than the pixel luminance fall rate 121 which results in a total luminance 123 that exceeds the average luminance 126 during the pixel transitions.

As shown in both FIGS. 2A and 2B, the difference in pixel rise and fall rates results in a predominately large luminance variation (i.e., luminance jump) from average luminance that is either positive or negative relative to average luminance. As shown in FIG. 2A, this predominately large negative luminance variation from average luminance results in a dark flash or flicker, while the predominately large positive luminance variation from average luminance shown in FIG. 2B results in a bright flash or flicker. As used herein with reference to luminance variation, the term predominately large refers a luminance jump (i.e., luminance variation) from average luminance that is substantially larger in total luminance variation (i.e., area above or below average luminance during particular luminance jump) relative to any other luminance jumps that may occur during the pixel rise and fall transition period.

In practice, the luminance flash is only discernible if large numbers of pixels perform complementary pixel transitions simultaneously. When large numbers of pixels perform these complementary transitions simultaneously, the actual luminance flash is the sum of individual pixel luminance flashes. Since the actual luminance rise and fall rates vary depending upon the initial and final state of the pixel transitions, the actual luminance variation depends upon the image content and can change slightly as the image content changes.

The graphs of FIG. 2A and FIG. 2B may be produced with an optical light sensor placed in front of a display, with the output of the sensor connected to an oscilloscope which measures voltage change relative to the luminance of the display. A display pattern of alternate white and black screens allows measurement of the pixel rise and fall times. A display pattern of scrolling alternating black and white lines allows measurement of the luminance flash with the oscilloscope. A scrolling random noise pattern is a fairly good simulation of a sonar waterfall display.

Figure 3A:
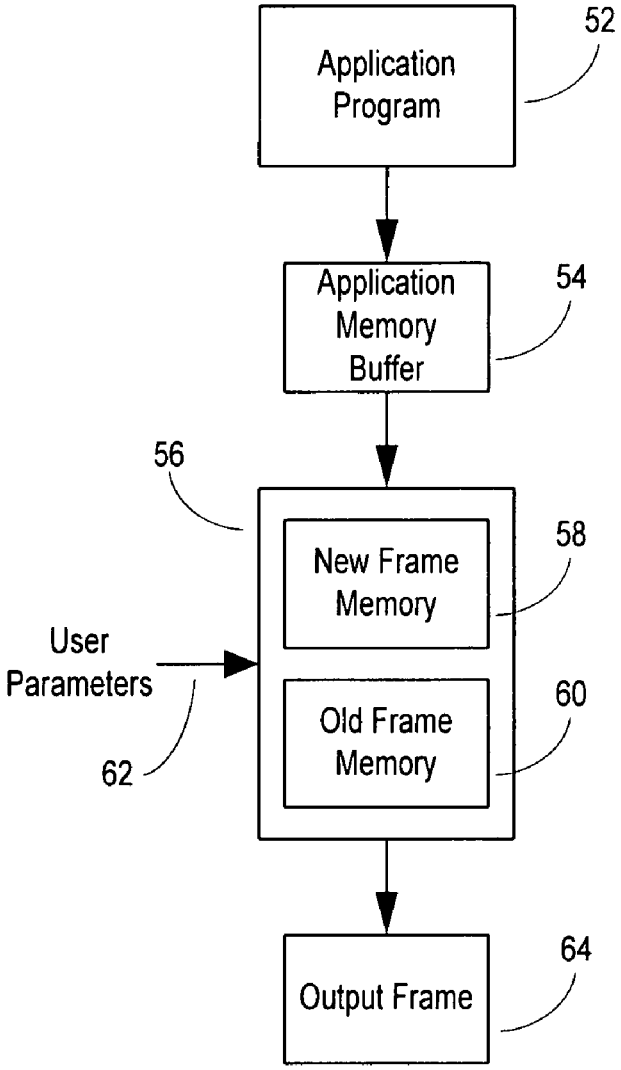
FIG. 3A shows a block diagram of one embodiment of an architecture that implements an algorithm according to the present invention for correcting flicker.

FIG. 3A shows a general embodiment of a software algorithm 56 as part of the system architecture 10 for use in reducing the luminance variation and producing the perception of substantial flicker reduction according to the present invention. The software program, for example, may be written using a graphics programming library such as OpenGL or DirectX.

As shown in FIG. 3A, an application program 52 (e.g., of an application processing system 14) generates display data, such as a sonar waterfall. Since software programs may output frames directly to an output frame buffer of a GPU prohibiting intercept, in one embodiment, the software output is directed to an application memory buffer 54 (e.g., portion of system memory 22) to allow intercept of the output frame. The application memory buffer 54 is, for example, formatted to contain computer data in Red Green Blue (RGB) format (e.g., including a number of bits representing each color) and resident in Central Processing Unit (CPU) memory space (e.g., system memory 22). The software algorithm 56 periodically copies the application memory buffer 54 to a new display frame memory buffer 58 (e.g., the algorithm intercepts a frame of new data destined for the display). Alternatively, the application memory buffer 54 and new frame memory buffer 58 may be identical, such that the application program 52 in fact renders directly to the new frame memory buffer 58. This may, for example, be supported in a graphical environment featuring render to texture capability with display compositing.

The software algorithm 56 contains a separate old display frame memory buffer 60 (e.g., portion of graphics memory 32) containing a copy of a previously displayed data frame which has already been processed and for which display has been initiated via output frame buffer 64 (e.g., portion of graphics memory 32). At least in one embodiment, the software algorithm 56 utilizes the new frame memory buffer 58, old frame memory buffer 60, and one or more user parameters 62 to generate transition frames for use in producing the substantial flicker reduction according to the present invention (e.g., causing creation of multiple luminance variations from average luminance that include both positive and negative luminance jumps that effectively cancel each other out as perceived by a user and further described herein).

One or more embodiments of the generation of transition frames and display of images based thereon according to the present invention to provide for the perception of flicker reduction are further described herein, along with various architectures for implementing such flicker reduction.

Figure 4A:
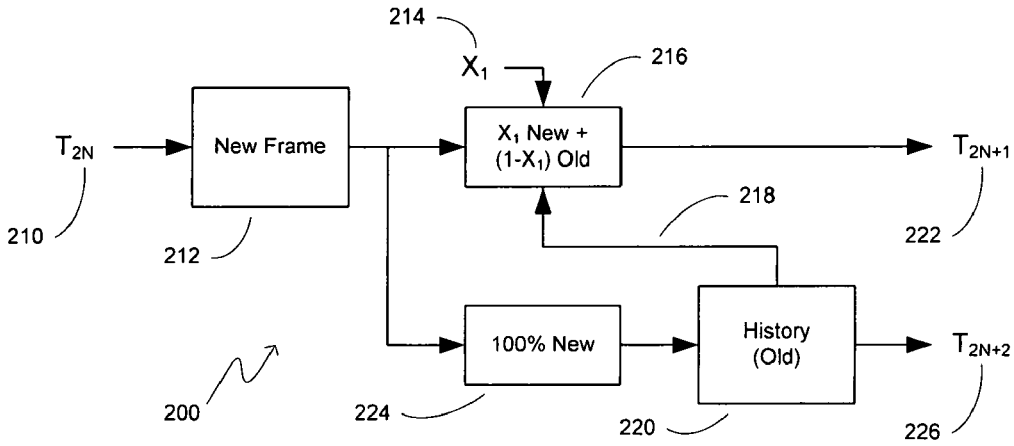
FIG. 4A shows a flow diagram of one embodiment of an algorithm according to the present invention for correcting flicker.

For example, one embodiment of the algorithm 56 generally shown in FIG. 3A is represented by the flow diagram of software algorithm 200 shown in FIG. 4A. Alternate embodiments of the algorithm 56 are represented by the flow diagrams of software algorithms 230 and 270, shown in FIG. 4B and FIG. 4C, respectively. The software algorithms 200, 230 and 270 which provide for the perception of constant average luminance to a user resulting in substantial flicker reduction include a software program, for example, written using a graphics programming library such as OpenGL or DirectX. However, implementation of the algorithms that generate one or more frames for display on display device 12 may take various forms as would be appreciated by one skilled in the art.

As shown in FIG. 4A, an old (i.e., previous) display data frame (N−1) 220 used to update the display 12 at a first time $T_{2N}$ is provided (as shown illustratively by line 218) for use in generating a transition data frame at block 216 for update of the display at a transition frame time $T_{2N+1}$, 222. Also at said first time $T_{2N}$ when the old display data frame 220 is being used to update the display 12, a new display data frame (N), to be used to update the display 12 at a second time ($T_{2N+2}$, 226) is also captured as represented generally by reference numeral 210 and recorded as a new frame 212 into a new frame buffer memory.

The transition data frame for use in updating the display 12 between the first and second update times is generated (block 216 as shown in FIG. 3A), for example, as a weighted sum of the old display data frame 220 and new display data frame 212 using one or more user selected parameters 214 as the weighting factor. Numerous alternatives to the weighted sum algorithm are possible, including using different weights optimized for specific level transitions or ranges of transitions. The weighted sum algorithm has the advantages of being simple and efficiently implemented, and only requires a single user selected parameter value 214. The transition data frame and the new display data frame are provided sequentially (222 and 226) as output frames for display (e.g., provided sequentially to output frame buffer 64 as shown in FIG. 3A). Further, the new display data frame 212 used to generate the at least one transition data frame at block 216 and to update the display at the second time $T_{2N+2}$ is also recorded (block 224) as the previously displayed data frame 220 and the process is repeated for a plurality of sequential display data frames provided by the application processing system 14. Taking, for example, the frame number N to be zero (0), said first time, transition frame time, and second time correspond to times T0, T1 and T2 respectively, as shown in FIG. 2C.

Allowing the user to select one or more parameters for use in generating the at least one transition data frame, permits the user to adjust the display of images for optimum viewing by the user with effective flicker reduction (e.g., the user may adjust the reduction of flicker as the images are being displayed, or in other words, on the fly or in real time as the display is being viewed). For example, each user in different circumstances may have different visual requirements (e.g., different environment, different eye characteristics, different display device characteristics, different data sources, etc.). Allowing the user to adjust the user selected parameters as they are using the display device to provide effective display of images with flicker reduction is particularly beneficial over a hardware implementation of flicker correction that does not allow for such user desired adjustment. For example, as the present invention is data set sensitive, the operator may make adjustments as the image source data changes. The variations of settings for different source data is due to the varying luminance rise and fall times for differing complementary transitions more prevalent with different types of data sources (e.g., a waterfall sonar image data set versus a radar image data set).

One will recognize that one transition data frame, or more than one transition data frame, may be generated for display between the first and second update times. However, at least in one embodiment, generating a single transition data frame for display between the first and second times is sufficient to provide the perception of constant average luminance by a user and as such, substantial flicker reduction.

Figure 2C:
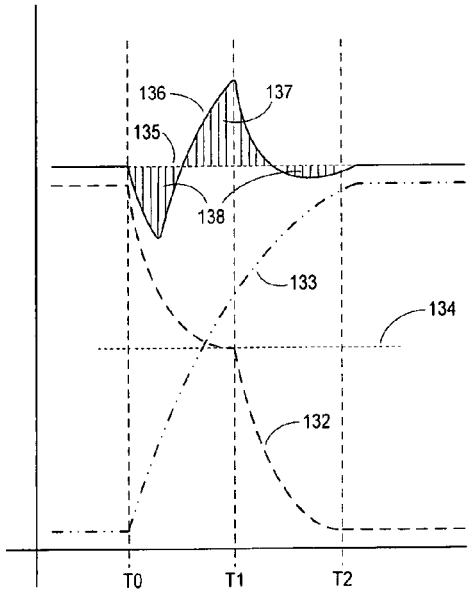
FIG. 2C shows a graph that illustrates opposing color state transitions at different rates resulting in both dark and bright luminance flashes that effectively cancel each other according to one embodiment of the present invention where insertion of one transition frame is employed.

For example, in one embodiment as shown by the graph of FIG. 2C and FIG. 4A, the algorithm 200 intercepts a frame of new data destined for the display 12, compares the new data 212 to the previous data 220 sent to the display 12, determines one transition frame (e.g., one transition frame to be inserted between adjacent previous and new display frames) based on the difference between the new and old data and on user provided parameters, and outputs the transition frame at $T_{2N+1}$, 222 first, and then, secondly, outputs the new frame at $T_{2N+2}$, 226.

The user parameters are selected to adjust the faster of the display pixel rise or fall rate, and insert a transition frame to slow the faster of the two rates. The adjusted transition frame (e.g., adjusted for optimal viewing), substantially reduces the flicker. This embodiment is beneficial for programs that generate data frames at a rate no more than half the refresh rate of the display. It also is particularly beneficial with LCDs that have pixel rise and fall times that complete most of their transition in no more than about two frames.

FIG. 2C shows an exemplary graph of luminance response over two frames, where the software algorithm 200 was used to insert a transition frame at time T1 in between an old or previous display frame at time T0 and a new display frame at time T2. The graph is based on a display device 12 that has a pixel fall rate 132 that is faster than the pixel rise rate 133. The transition value 134 for the transition data frame at time T1 selects an intermediate luminance level for the pixel having falling luminance.

Proper selection of the transition value 134 (e.g., via an input mechanism available to the user) results in a perceived constant average luminance over the period between the two display frames at T0 and T2. The perceived constant average luminance (e.g., perceived by a user) results from the transition value 134 (e.g., set by a user) being set such that the display of the transition data frame displayed at T1 creates multiple luminance variations (e.g., luminance jumps or variations 136 and 138) from average luminance 135 in both the positive and negative direction relative to average luminance 135 which cancel each other out over time as perceived by the user (e.g., the sum of the area between the actual luminance 136 and the average luminance 135 is close to zero, and may even be zero). For example, the sum of the positive luminance variation area 137 above the average luminance 135, and negative luminance variation area 138 below the average luminance 135, is at least close to zero (or zero). As used herein, the terms about zero or close to zero made with reference to the sum of positive and negative luminance variations refers to the sum being zero in one embodiment, and sufficiently close to zero in other embodiments such that at least a perceivable level of flicker reduction is accomplished using the present invention relative to a non-flicker reduced display.

As illustrated in FIG. 2C, it is readily apparent that luminance jumps still occur even with the insertion of a transition data frame at T1. However, unlike the illustrations provided in FIGS. 2A and 2B, there is no predominately large luminance variation from average luminance that is either just positive or negative relative to average luminance. Rather, the insertion of the transition data frame creates multiple luminance variations from average luminance that are both positive and negative. The magnitude of the luminance variations from average luminance in the illustrative technique shown in FIG. 2C may be as large as the magnitude of the predominately large luminance jumps illustrated in FIGS. 2A and 2B (e.g., a shorter time length variation with a large magnitude), or may be of lesser magnitude. Likewise, the length of time of such luminance variation may also be the same or less in one or more embodiments. However, the technique illustrated in FIG. 2C employs the creation of multiple luminance variations including both positive and negative luminance jumps relative to average luminance as needed to create the perception of constant average luminance to a user.

As such, although the display device 12 exhibits both dark and bright flashes (e.g., luminance jumps relative to average luminance), the fact that multiple luminance variations (e.g., luminance jumps or variations 136 and 138) from average luminance 135 are created in both the positive and negative direction relative to average luminance 135 allows the slow response time of the human eye to integrate the flashes creating the perception constant average luminance to a user and substantial flicker reduction. As previously indicated herein, each user in different circumstances may have different visual requirements (e.g., different environment, different eye characteristics, different display device characteristics, different data sources, etc.), and as such, different perception characteristics as well. Allowing the user to adjust, for example, the transition value 134, allows the user to optimize the display according to that particular user's perception (e.g., sufficient to create substantial flicker reduction for that particular user).

The algorithm 200 may be implemented in the software program architecture that is shown generally in FIGS. 1 and 3. Equivalent embodiments using the X Windows graphics library and the OpenGL graphics programming library or other graphics programming libraries such as DirectX should be obvious to one skilled in the art. OpenGL, like DirectX, supports the creation of custom processing functions including fragment shaders and vertex shaders that can be downloaded and executed on a graphics processing unit (GPU).

For example, in implementation of the algorithm 200 as implemented in the architecture shown in FIG. 3A, the application program 52 generates display data frames, such as a sonar waterfall, which are provided to application memory buffer 54. The application memory buffer 54 may be formatted to contain computer data in Red Green Blue (RGB) format; typically including eight bits representing each color and resident in Central Processing Unit (CPU) memory space (e.g., system memory 22). The software algorithm 56 takes the form of algorithm 200 which periodically copies the application memory buffer 54, preferably to a new display frame memory buffer 58 (e.g., a memory buffer for recording new frame 212) resident within the GPU. This memory copy is preferably synchronized to the display refresh rate (e.g., vertical retrace), which is a function supported by OpenGL, but at half the refresh rate (e.g., alternating frames).

The software algorithm contains a separate old display frame memory buffer 60 (e.g., a memory buffer for recording old display data frame 220), also resident within the GPU, containing a copy of the previous display frame which has already been processed and displayed via the GPU output frame buffer 64. The software algorithm utilizes the new frame memory buffer 58 (e.g., a memory buffer for recording new frame 212), old frame memory buffer 60 (e.g., a memory buffer for recording old display data frame 220), and user parameters 62 (e.g., user parameters 214) to produce two sequential output frame buffers; the first including the transition data frame to be initiated at time T1 generated using the user parameters 62 (e.g., user parameters 214) and the second including the new display data frame to be initiated at time T2. The GPU output frame buffer 64 is converted to standard display signals at the display refresh rate, such as RGB format or Digital Video Interface (DVI) format, which then connect to the display device 12 (e.g., an LCD) providing display of the data.

Table I shows one embodiment of a portion of such a flicker reduction software algorithm 200 used to reduce flicker. The flicker reduction software algorithm is a pseudo-coded algorithm similar to the C programming language using the OpenGL library based on the pixel shader capability available in OpenGL 2.0. Specifically, the flicker reduction software function shown in Table I uses a fragment shader program that is downloaded to the GPU through the GPU device driver program. The fragment shader is a function within the GPU that runs identically across each display pixel, with potentially many pixels processed concurrently. The fragment shader, shown separately as function Blend, determines rise and fall transitions for each color (Red, Green and Blue), which is typically easier than determining composite luminance of the three colors and handles color shades.

The flicker reduction software algorithm may be implemented as a background process or separate process thread designed to synchronize to the display refresh rate, capture the application program memory buffer, provide user access to controls to select the user parameters, and call the flicker reduction function Blend for each vertical refresh cycle. In addition, double buffering of the output frame buffer may be used to support synchronized switching of the frame buffer output with the vertical refresh timing to eliminate asynchronous display artifacts such as display tearing.

TABLE I

Flicker Reduction Software Algorithm

```
1. FlickerReduce(Rise, Fall, Display_Update)
2. {
3. new = Display_Update;
4. old = Display_History;
5. Blend(new, old, Rise, Fall);
6. Blend(new, old, 1, 0);
7. Display_History = new;
8. }
9.
10. // mix(x,y,a) = x + a(y−x) = x(1−a) + ya
11. Blend(new, old, Rise, Fall)
12. {
13. for (color = red, green, blue) {
14.     if (new.color > old.color)
15.         result.color = mix(old.color, new.color, Rise);
16.     else
17.         result.color = mix(new.color, old.color, Fall);
18. }
19. output(result);    // Synchronized with Frame Rate
20. return(result);
21. }
```

Comments on Flicker Reduction Software Algorithm:

1. Begin the declaration of the main algorithm function named FlickerReduce with parameters Rise, Fall, and Display_Update, where parameter Rise is a user selected percentage corresponding to the selected transition state of a rising pixel transition which is used if the pixel rise time is faster than the pixel fall time, where parameter Fall is a user selected percentage corresponding to the selected transition state of a falling pixel transition which is used if the pixel fall time is faster than the pixel rise time, and where Display_Update the new frame memory buffer containing the new data to be displayed which was copied from the application memory buffer.
2. Begin the body of function FlickerReduce.
3. Assign the variable new to access the new frame buffer in Display_Update.
4. Assign the variable old to access the old frame buffer in Display_History.
5. Call the fragment shader function Blend to produce the transition frame using the new frame, old frame, and Rise and Fall parameters.
6. Call the fragment shader function Blend to produce the new frame using the new frame, old frame (not used), 100% for the Rise and 0% for the Fall parameters.
7. Set the Display_History to the new frame buffer for the next iteration.
8. Close the body of function FlickerReduce.
9. Blank line for separation.
10. Comment describing the algorithm of the standard pixel shader mix function.
11. Begin the declaration of fragment shader function Blend with parameters New, Old, Rise and Fall, where parameter New is the new frame memory buffer, parameter Old is the old frame memory buffer, parameter Rise is the Rise parameter and parameter Fall is the Fall parameter.
12. Begin the body of fragment shader function Blend.
13. Begin loop through each of the colors Red, Green and Blue.
14. Compare color field of new memory frame buffer to corresponding color field of old memory frame buffer.
15. If the new color is greater than the old color, then a rising transition is detected so mix the old and new colors with Rise percentage of the new color and one minus the Rise percentage of the old color. Result is the final pixel value to be output to the frame buffer.
16. Else clause.
17. If the new color is less than the old color, then a falling transition is detected so mix the old and new colors with Fall percentage of the old color and one minus the Fall percentage of the new color. Result is the final pixel value to be output to the frame buffer.
18. Close the For loop for each color.
19. Output Result containing the final value of the pixel in RGB format to the GPU output frame buffer.
20. Return the output frame buffer. Note that the return frame value is not used in the FlickerReduce( ) algorithm of Table I, but may be used in one or more alternate embodiments.
21. Close the fragment shader function Blend.

There are numerous alternate embodiments of the software algorithm that can be used to deal with variations of the key characteristics of the system. For example, an alternate embodiment of the software algorithm can be used if the input frame rate allows more than two transition frames to be inserted between display data frames generated by the application processing system. Use of this software algorithm may reduce the amplitude of the luminance flashes by spreading them over a longer period of time by using additional transition frames and potentially slowing both the rise and fall times.

Figure 2D:
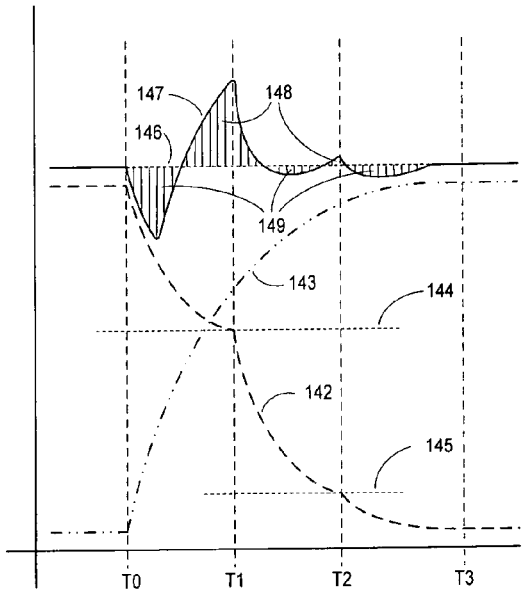
FIG. 2D shows a graph that illustrates another embodiment of the present invention where insertion of two transition frames is employed.

This approach may be useful particularly for displays with a very high frame rate relative to the pixel rise and fall rates (i.e., when the pixel transition times exceed two frames). For example, as shown in FIG. 2D, two transition frames may be output instead of one (e.g., as described with reference to FIG. 2C), to slow the faster of the rising 143 or falling 142 transition over two intermediate frame periods before the final new frame is output. FIG. 2D shows the two transition frames at times T1 and T2, with the full transition completed by the output of the new frame data at time T3, which becomes the history data at time T0 of the next iteration of the process.

The perception of constant average luminance over the period between the two display frames at T0 and T3 is provided by the selection of optimal transition values 144 and 145 such that the sum of the area between the actual luminance 147 and the average luminance 146 is close to zero (or zero). For example, as shown in FIG. 2D, the sum of the positive luminance variations including areas 148 above the average luminance 146, and the negative luminance variations including areas 149 below the average luminance 146 is close to zero (or zero), creating the perception of constant average luminance to a user and substantial flicker reduction.

Figure 4B:
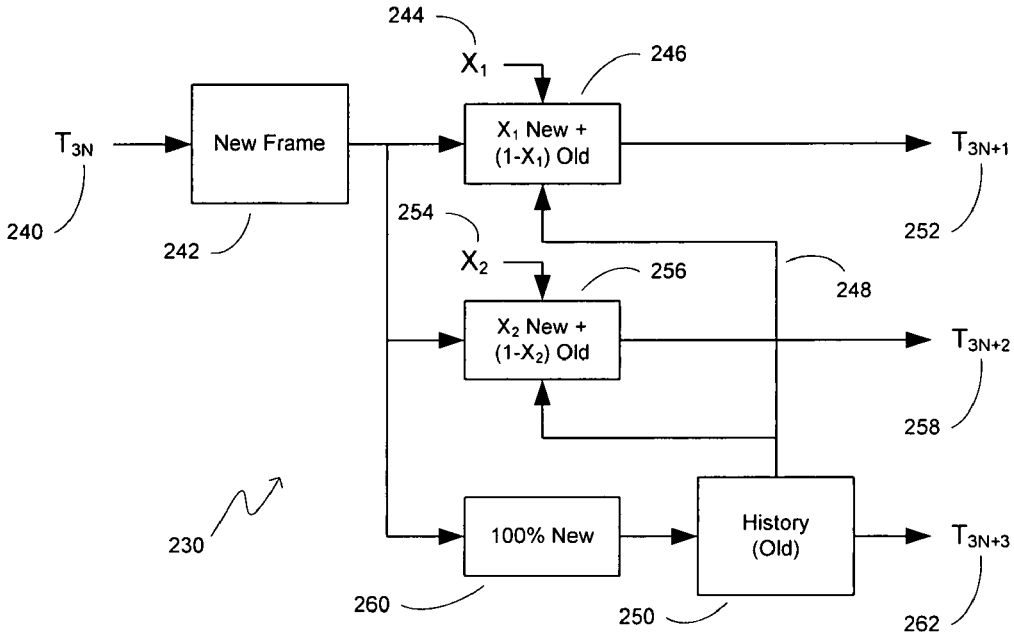
FIG. 4B shows a flow diagram of one embodiment of an alternate algorithm according to the present invention for correcting flicker using one transition frame.

The algorithm 56 implementing this alternate embodiment is represented by the flow diagram of software algorithm 230, shown in FIG. 4B. An old display data frame (N−1) 250 used to update the display 12 at a first time $T_{3N}$ is provided (as illustratively shown by line 248) for use in generating transition data frames at blocks 246 and 256 for update of the display at a transition frame time $T_{3N+1}$, 252 and a transition frame time $T_{3N+2}$, 258, respectively. Also at said first time $T_{3N}$ when the old display data frame 250 is being used to update the display, a new display data frame (N) to be used to update the display 12 at a second time $T_{3N+3}$ is also captured as shown generally by reference numeral 240 and the new frame 242 is recorded into a new frame buffer memory.

Two transition data frames for use in updating the display 12 at first and second transition frame times between the first and second update times are generated (block 246 and block 256), for example, as weighted sums of the old display data frame 250 and new display data frame 242 using one or more user selected parameters 244 and 254 as the weighting factor for the first and second transition frames, respectively. As described with reference to FIG. 4A and algorithm 200, numerous alternatives to the weighted sum algorithm are possible.

The algorithm 230 outputs the transition frames at $T_{3N+1}$, 252 and $T_{3N+2}$, 258 first, and then, secondly, outputs the new frame 242 at $T_{3N+3}$, 262 as output frames for display (e.g., provided sequentially to output frame buffer 64 as shown in FIG. 3A). Further, the new display data frame 242 used to generate the two transition data frames is also recorded (block 260) as the previously displayed data frame 250 and the process is repeated for a plurality of sequential display data frames provided by the application processing system 14. Taking, for example, the frame number N to be zero (0), said first time, first transition frame time, second transition frame time, and second time correspond to times T0, T1, T2 and T3 respectively, as shown in FIG. 2D.

By comparison, it is readily apparent that algorithms 200 and 230 utilizing one transition frame and two transition frames, respectively, could be extended as alternate embodiments of the present invention to utilize additional transition frames by replicating the blending steps 216, or 246 and 256, and using sequential output of such transition frames.

While the embodiment exemplified in FIG. 2C samples input display data at up to half the video refresh rate of the display device, it is also possible to sample the input display data at the full video refresh rate. This approach may provide acceptable results if the scroll rate is less than half the refresh rate or the data set noise pattern is such that pixels do not typically change with each refresh cycle. Otherwise, pixels may not make their complete transition and contrast may be reduced.

Figure 4C:
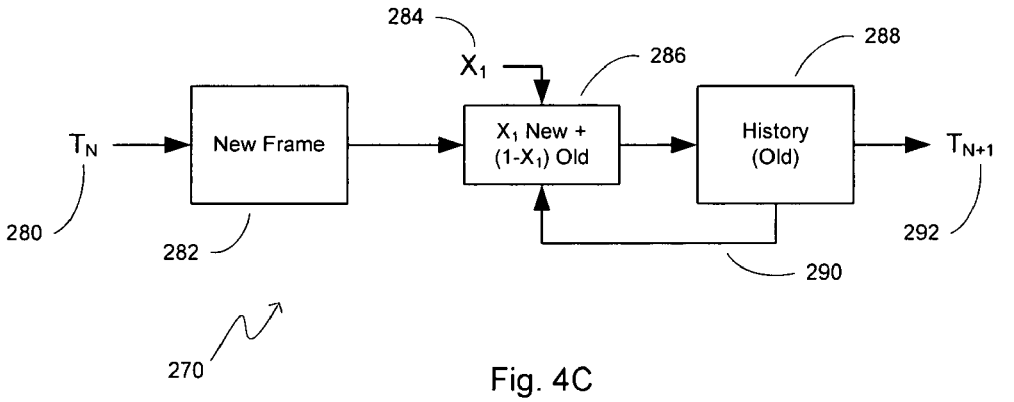
FIG. 4C shows a flow diagram of one embodiment of an alternate algorithm according to the present invention for correcting flicker using two transition frames.

The flow diagram of FIG. 4C shows one exemplary embodiment of an alternate software algorithm 270 that may be used to provide reduced flicker when the input display data is sampled, for example, at the full video refresh rate of the display device 12. As shown in FIG. 4C, a new display data frame 282 (e.g., of a plurality display data frames, such as, sequential display data frames generated by application processing system 14) is captured. A transition data frame for use in updating the display device 12 is generated using one or more user selected parameters 284, the previously displayed data frame 288 (e.g., the previous transition data frame provided as shown via reference numeral 290), and the new display data frame 282. The at least one transition data frame is provided as the output frame for display at $T_{N+1}$, 292. Further, the transition data frame generated and provided as the output frame for initiating display of an image on the display device 12 is also recorded and retained as the old data frame 288 and the process is repeated for a plurality of sequential display data frames 280 provided by the application processing system 14. Like the previously described embodiments, allowing the user to select one or more user selected parameters for use in generating the at least one transition data frame, allows the user to adjust the display of images for optimum viewing by the user with effective flicker reduction.

Table II shows at least a portion of one embodiment of this alternate software algorithm which does not insert one or more transition frames before outputting the actual new image frame such as described in the exemplary algorithm of Table I. Rather, the algorithm shown in Table II recursively calculates and outputs a new transition frame that is some percentage of a new image frame (e.g., copied to the new frame memory) blended with a previously calculated output transition frame (e.g., copied to the old frame memory), such as with use of one or more user selected parameters.

TABLE II

Flicker Reduction Software Algorithm 2

```
1. FlickerReduce2(Rise, Fall, Display_Update)
2. {
3. new = Display_Update;
4. old = Display_History;
5. Display_History = Blend(new, old, Rise, Fall);
6. }
```

Comments on Flicker Reduction Software 2 Algorithm:

1. Begin the declaration of the main algorithm function named FlickerReduce with parameters Rise, Fall, and Display_Update, where parameter Rise is a user selected percentage corresponding to the selected transition state of the Rise which is used if the pixel rise time is faster than the pixel fall time, where parameter Fall is a user selected percentage corresponding to the selected transition state of the pixel fall time which is used if the pixel fall time is faster than the pixel rise time, and where Display_Update the new frame memory buffer containing the new data to be displayed which was copied from the application memory buffer.
2. Begin the body of function FlickerReduce2.
3. Assign the variable new to access the new frame buffer in Display_Update.
4. Assign the variable old to access the old frame buffer in Display_History.
5. Call the fragment shader function Blend (Table I) to produce the transition frame using the new frame, old frame, and Rise and Fall parameters and set the Display_History for the next iteration.
6. Close the body of function FlickerReduce.

Figure 3B:
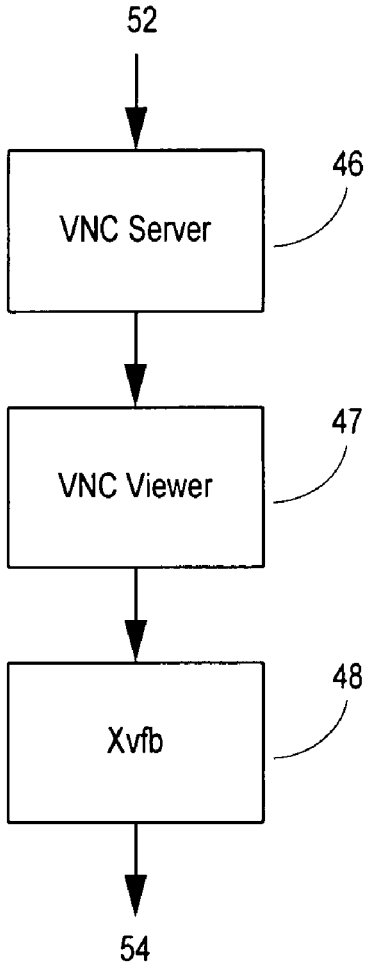
FIG. 3B shows a block diagram of one embodiment of an alternate architecture that implements an algorithm according to the present invention for correcting flicker.

An alternate system architecture embodiment of the present invention may include a thin client architecture as described with reference to FIG. 3B. FIG. 3B shows a thin client architecture with an application server and one or more client displays. This example utilizes the X Windowing system and the corresponding thin client Virtual Network Computing (VNC) software Xvnc including a VNC server 46 serving the display to a VNC viewer 47. This architecture shows the use of the X Virtual Frame Buffer (Xvfb) 48 utility to output the display image to memory 54 for the software algorithm to capture and reduce flicker. Each display operator may adjust the user parameters to reduce flicker according to the needs of each specific display device or user (e.g., LCD), without impacting the application program. The equivalent embodiment is possible with other thin client programs.

Another alternate embodiment of the system architecture uses a composite manager architecture. A composite manager is a program that redirects window rendering to off-screen memory within the GPU, and then provides algorithms for further processing the window or multiple windows before sending output to the output frame buffer. This alternate embodiment is useful because the application program renders its image to GPU memory using the GPU hardware instead of rendering to CPU memory with a software implementation of a GPU so it may result in higher system performance because of lower CPU load.

In summary, one or more embodiments of the present invention may provide one or more advantages. For example, one or more embodiments may allow user adjustment of parameters that compensate for a variety of variables such as data set or image variation, temperature, human eye sensitivity, display viewing angle and a variety of different LCD manufacturers. In one or more embodiments, the requirement for only one, or a very small number, of user parameters provides the advantage of simple implementation and easy operator calibration.

Further, for example, the software algorithm only modifies data in a display window that exhibits a need for flicker reduction and leaves other windows unaffected. Yet further, for example, the software algorithm runs on many types of computers with several standard GPU devices and GPU libraries and it supports numerous system architectures including thick client and thin client approaches. As such, the present invention may be implemented in one of various manners and is not to be taken as limited to any particular embodiment (e.g., architecture) described herein.

All patents and references cited herein are incorporated in their entirety as if each were incorporated separately. This invention has been described with reference to illustrative embodiments and is not meant to be construed in a limiting sense. As described previously, one skilled in the art will recognize that various modifications of the illustrative embodiments, as well as additional embodiments to the invention and combinations of various elements and/or steps herein, will be apparent to persons skilled in the art upon reference to this description. It is therefore contemplated that the patent and claims will cover any such modifications or embodiments that may fall within the scope of the present invention, as defined by the accompanying claims.

We claim:

1. A method for use in correcting flicker in a liquid crystal display comprising a plurality of pixel elements having luminance rise rates that are different than luminance fall rates, the flicker being caused by at least some of the plurality of the pixel elements that have different luminance rise and fall rates performing complementary transitions simultaneously, wherein the method comprises:

providing a first display data frame of a plurality of sequentially provided display data frames, the first display data frame for use in initiating display of a first image by the plurality of pixel elements at a first time;

providing a second display data frame subsequent to the first display data frame for use in initiating display of a subsequent image by the plurality of pixel elements at a second time; and inserting at least one transition data frame between the first display data frame and the subsequent second display data frame for use in displaying a transition image by the plurality of pixel elements such that a user perceives display of a constant average luminance by the plurality of pixel elements to reduce the flicker caused by the plurality of pixels having luminance rise rates that are different than luminance fall rates when the plurality of pixels perform complementary transitions simultaneously, wherein the display of the transition image causes a plurality of luminance variations from average luminance, wherein the plurality of luminance variations from average luminance comprise both positive and negative luminance variations relative to average luminance such that the plurality of luminance variations cancel each other out over time as perceived by the user.

2. The method of claim 1, wherein only one transition data frame is generated for insertion.

3. The method of claim 1, wherein inserting at least one transition data frame between the first display data frame and the subsequent second display data frame comprises generating the at least one transition data frame using the subsequent second display data frame, the first display data frame, and one or more user provided parameters.

4. The method of claim 3, wherein inserting at least one transition data frame between the first display data frame and the subsequent second display data frame comprises:

recording the copy of the first display data frame in a previous frame memory buffer upon being provided for use in initiating display of a first image by the plurality of pixel elements at the first time;

copying the subsequent second display data frame to a new frame memory buffer;

generating the at least one transition data frame using the subsequent second display data frame copied to the new frame memory buffer, the first display data frame copied to the previous frame memory buffer, and the one or more user provided parameters;

providing the at least one transition data frame for use in displaying at least one transition image by the plurality of pixel elements; and recording a copy of the second display data frame in the previous frame memory buffer upon being provided for use in initiating display of the second image by the plurality of pixel elements at the second time.

5. The method of claim 3, wherein inserting at least one transition data frame between the first display data frame and the subsequent second display data frame comprises generating a plurality of transition data frames for insertion between the first display data frame and the subsequent second display data frame.

6. The method of claim 3, wherein the one or more user provided parameters comprise a selected percentage corresponding to a selected transition state of a pixel element.

7. The method of claim 1, wherein a user viewing the displayed image is provided with an input mechanism for receiving input to adjust one or more parameters upon which the at least one transition data frame is based.

8. The method of claim 1, wherein the plurality of pixel elements foam a window within a display that includes additional pixel elements for displaying one or more other images.

9. The method of claim 1, wherein the positive luminance variations from average luminance are about equal to the negative luminance variations from average luminance.

10. A method for use in correcting flicker of a liquid crystal display comprising a plurality of pixel elements having luminance rise rates that are different than luminance fall rates, the flicker being caused by at least some of the plurality of the pixel elements that have different luminance rise and fall rates performing complementary transitions simultaneously, wherein the method comprises:

providing a plurality of display data frames to be sequentially displayed using the plurality of pixel elements;

inserting at least one transition data frame between each display data frame and a subsequent display data frame of the plurality of the display data frames, the at least one transition data frame being generated using one or more user provided parameters, wherein inserting at least one transition data frame between each display data frame and a subsequent display data frame comprises displaying a transition image by the plurality of pixel elements such that a user perceives display of a constant average luminance by the plurality of pixel elements to reduce the flicker caused by the plurality of pixels having luminance rise rates that are different than luminance fall rates when the plurality of pixels perform complementary transitions simultaneously, wherein the display of the transition image causes a plurality of luminance variations from average luminance, wherein the plurality of luminance variations from average luminance comprise both positive and negative luminance variations relative to average luminance such that the plurality of luminance variations cancel each other out over time as perceived by the user; and providing an input mechanism to a user for modifying the one or more user provided parameters used to generate the at least one transition data frame so as to allow the user to adjust one or more luminance characteristics of the display of the plurality of display data frames using the plurality of pixel elements.

11. The method of claim 10, wherein only one transition data frame is generated for insertion between each display data frame and a subsequent display data frame.

12. The method of claim 11, wherein the display comprises a liquid crystal display having a plurality of pixels, wherein the pixels have a pixel luminance rise and fall time that are completed in no more than about two frames displayed thereon.

13. The method of claim 11, wherein the display comprises a liquid crystal display having a plurality of pixels, wherein providing a plurality of display data frames comprises providing a plurality of sequential display data frames at a rate no more than half the refresh rate of the display.

14. The method of claim 10, wherein the at least one transition data frame inserted between a display data frame and a subsequent display data frame is generated using a copy of the display data frame and the subsequent display data frame between which the at least one transition data frame is inserted, in addition to the one or more user provided parameters.

15. The method of claim 10, wherein the at least one transition data frame comprises more than one transition data frame.

16. The method of claim 10, wherein the one or more user provided parameters comprise a selected percentage corresponding to a selected transition state of one or more pixel elements.

17. The method of claim 10, wherein the plurality of pixel elements form a window within a display that includes additional pixel elements for displaying one or more other images.

18. A system for use in correcting flicker of a liquid crystal display device comprising a plurality of pixel elements having luminance rise rates that are different than luminance fall rates, the flicker being caused by at least some of the plurality of the pixel elements that have different luminance rise and fall rates performing complementary transitions simultaneously, wherein the system comprises:

application processing apparatus to generate a plurality of sequential display data frames;

a new frame memory buffer to receive a copy of a new display data frame of the plurality of sequential display data frames to be displayed;

a previous frame memory buffer to receive a copy of a display data frame of the plurality of sequential display data frames which has been provided for display by the plurality of pixel elements; and processing apparatus to generate at least one transition data frame to be inserted between each display data frame and a subsequent display data frame of the plurality of sequential display data frames, wherein the at least one transition data frame is generated using a new display data frame copied to the new frame memory buffer, a display data frame copied to the previous frame memory buffer, and one or more user provided parameters, wherein the one or more user provided parameters comprise at least one parameter based at least in part on the rise and fall times of the plurality of pixel elements; and further wherein the insertion of the at least one transition data frame between each display data frame and the subsequent display data frame causes display of transition images by the plurality of pixel elements such that a user perceives display of a constant average luminance by the plurality of pixel elements to reduce the flicker caused by the plurality of pixels having luminance rise rates that are different than luminance fall rates when the plurality of pixels perform complementary transitions simultaneously, wherein the display of the transition image causes a plurality of luminance variations from average luminance, wherein the plurality of luminance variations from average luminance comprise both positive and negative luminance variations relative to average luminance such that the plurality of luminance variations cancel each other out over time as perceived by the user.

19. The system of claim 18, wherein the processing apparatus generates only one transition data frame for insertion into the plurality of sequential display data frames for display prior to a subsequent display data frame and after the display data frame copied to the previous frame memory buffer.

20. The system of claim 19, wherein the display device comprises a liquid crystal display having a plurality of pixels, wherein the pixels have a pixel luminance rise and fall time that are completed in no more than about two frames displayed thereon.

21. The system of claim 19, wherein the display device comprises a liquid crystal display having a plurality of pixels, wherein the application processing apparatus generating a plurality of sequential display data frames generates display data frames at a rate no more than half the refresh rate of the display device.

22. The system of claim 18, wherein the one or more user provided parameters comprise a selected percentage corresponding to a selected transition state of a pixel element.

23. The system of claim 18, wherein the system further comprises an input mechanism configured to allow a user to modify the one or more user provided parameters used to generate the at least one transition data frame.

24. The system of claim 18, wherein the plurality of pixel elements form a window within the display device that includes additional pixel elements for displaying one or more other images.

* * * * *